US005895093A

United States Patent [19]

Casey et al.

[11] Patent Number: 5,895,093

[45] Date of Patent: Apr. 20, 1999

[54] RECLINER LIFT CHAIR WITH SWIVEL BASE

[76] Inventors: Kenneth Casey, 50 Deer Run Rd., Plymouth Township, Pa. 18651; Kenneth Kemmerer, 768 Keating St., Wilkes-Barre, Pa. 18702

[21] Appl. No.: 08/939,161

[22] Filed: Sep. 29, 1997

Related U.S. Application Data

[63] Continuation of application No. 08/643,959, May 7, 1996, abandoned.

[51] Int. Cl.[6] ..... A47C 1/02

[52] U.S. Cl. ..... 297/344.23; 297/344.26; 297/330; 297/344.17; 248/157; 248/425

[58] Field of Search ..... 297/330, 344.23, 297/344.17, 344.26, DIG. 10; 248/157, 425, 421, 359.1

[56] References Cited

U.S. PATENT DOCUMENTS

| | | | |
|---|---|---|---|
| 1,228,434 | 6/1917 | Hedberg . | |
| 2,864,431 | 12/1958 | Eaton . | |
| 2,987,116 | 6/1961 | Golden . | |
| 3,123,400 | 3/1964 | Paulson . | |
| 3,307,820 | 3/1967 | Martin . | |
| 3,596,982 | 8/1971 | Grams . | |
| 4,007,960 | 2/1977 | Gaffney . | |
| 4,083,599 | 4/1978 | Gaffney . | |
| 4,173,372 | 11/1979 | Norris | 297/344.17 |
| 4,351,562 | 9/1982 | Twitchell et al. | 297/344.17 |
| 4,600,239 | 7/1986 | Gerstein et al. . | |
| 4,802,706 | 2/1989 | Onimaru et al. . | |
| 4,846,529 | 7/1989 | Tulley . | |
| 4,946,222 | 8/1990 | Matson . | |
| 4,969,685 | 11/1990 | Chihaya et al. . | |
| 4,993,777 | 2/1991 | LaPointe . | |
| 5,024,486 | 6/1991 | Auel . | |
| 5,341,894 | 8/1994 | Van Gorder et al. | 297/DIG. 10 |
| 5,489,142 | 2/1996 | Mathieu . | |

*Primary Examiner*—Peter R. Brown
*Assistant Examiner*—Anthony D. Barfield
*Attorney, Agent, or Firm*—David A. Tamburro

[57] ABSTRACT

An electrically operated lift chair/recliner which includes a swivel base having a power drive that permits an occupant to turn the chair to the left or right as desired.

11 Claims, 3 Drawing Sheets

RECLINER LIFT CHAIR WITH SWIVEL BASE

This application is a continuation of application Ser. No. 08/643959, filed May 7, 1996, now abandoned.

BRIEF DESCRIPTION OF INVENTION

This invention relates to power operated lift recliner chairs and more particularly to a lift recliner chair in which the chair is mounted on a swivel base which enables the occupant to turn the chair to the left of right of a center position.

Power operated lift recliner chairs are commonly used by persons needing assistance in transferring from a seated position in a chair to a standing position includes a power operated lift mechanism which raises the chair and tilts it forwardly to bring its occupant to a standing position, and in reverse lowers the occupant from a standing to a seated position. The chair also shifts rearwardly to one or more reclining rest positions. U.S. Pat. Nos. 4,007,960, 4,083,599, and 4,993,777 illustrate various prior lift chairs and their operating mechanisms. Lift chairs of this general type are well known and are sold commercially by American Dream International of Kingston, Pa. and others. To date the movement in power operated lift chairs has been limited to up, down and reclining movement, and an occupant has not been able to swivel or turn the chair to the left or right toward another person or another object such as a television set. This desirable feature is often incorporated into a standard manually operated swivel recliner which of course does not have a lift and tilt capability.

SUMMARY OF THE INVENTION

Accordingly a primary object of this invention is to provide a novel power operated lift chair or a lift recliner chair which may be turned or swiveled to the left or right by a power drive mechanism under control of the occupant of the chair.

A further object of the invention is to provide the above novel lift chair having a lift, tilt and recline mechanism mounted on a support base assembly which permits the chair to be swiveled or turned under power controlled by the occupant.

Another object of the invention is to provide the above novel lift chair including control means which prevents the chair from being swiveled when the chair is in a raised and/or tilted position.

Other objects and advantages will become apparent from reading the following detailed description of the invention wherein reference is made to the accompanying drawings.

DETAILED DESCRIPTION OF THE INVENTION

Figure 1:
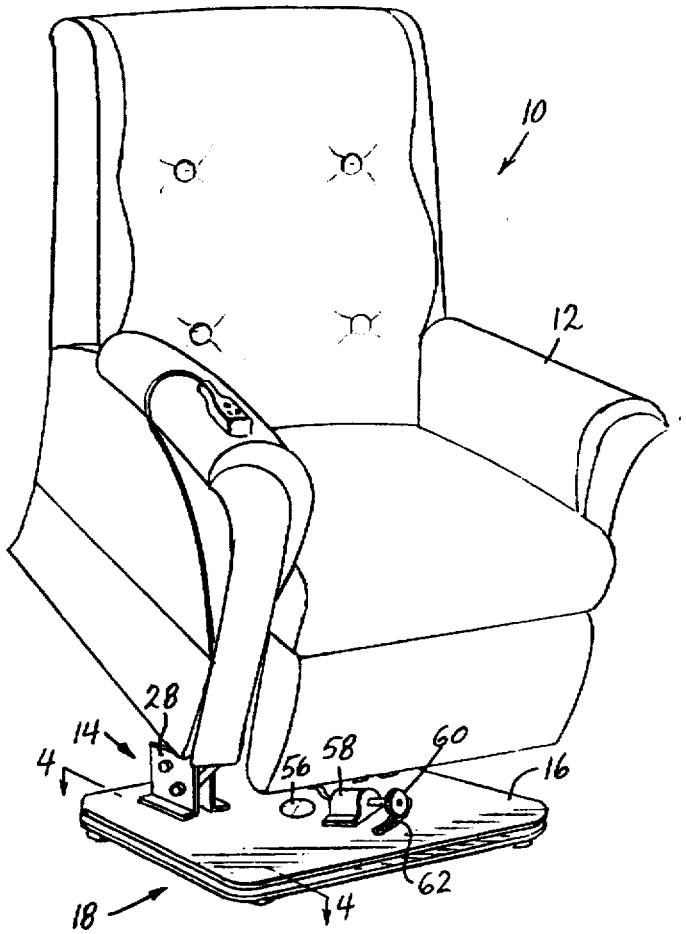
FIG. 1 is a front perspective view of a lift chair of the invention with the chair in its raised, forwardly tilting position.
Figure 2:
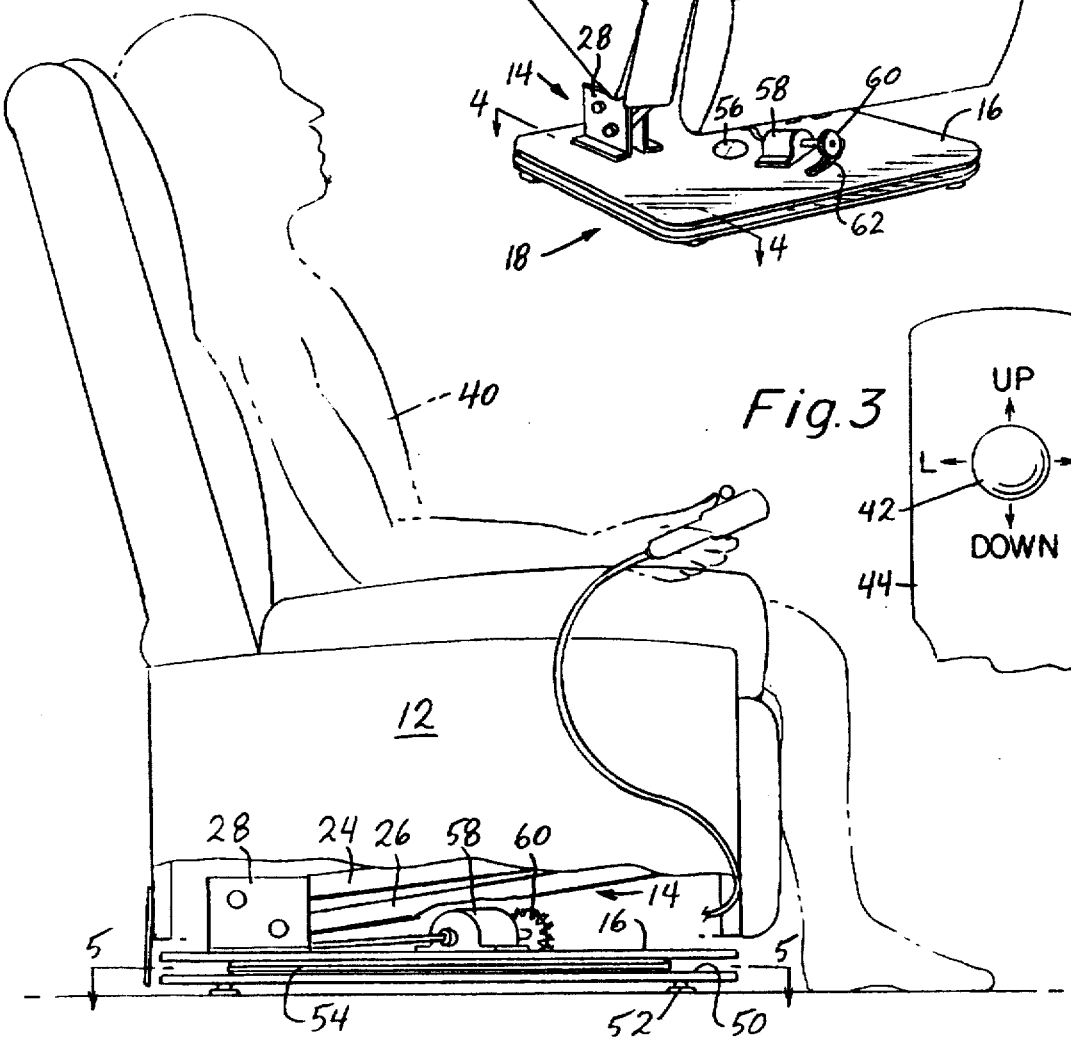
FIG. 2 is a partially fragmented side elevational view of the lift chair of FIG. 1 with the chair in its lowered seating position.
Figure 3:
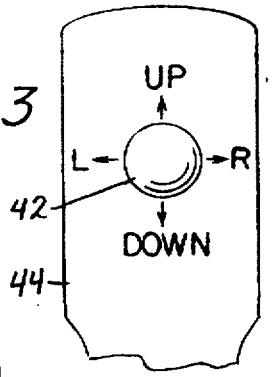
FIG. 3 is a fragmentary schematic of a hand operated switch by which the occupant may control operation of the lift, tilt, and recliner mechanism and the swivel mechanism.

Referring now to FIGS. 1 and 2 of the drawings, the novel lift chair or lift recliner 10 of the invention includes a chair 12 supported by a lift, tilt and recline mechanism 14 mounted on an upper support plate 16 of base assembly 18. Mechanism 14 is of conventional type and includes a pair of laterally spaced lift arm assemblies 20 and 22 each including upper and lower arms 24, 26 pivotally connected at their rear ends to brackets 28 which are fixed on top of plate 16. The front ends of arms 24, 26 are pivotally connected in conventional fashion to a frame (not shown) within chair 12. A reversible electric motor/reducer unit 30, such as a Hubbell Model No. MC42-1007H, is mounted for pivoting movement about a horizontal axis via bracket 32 at the rear of plate 16 and includes an upwardly inclined threaded rod 34 connected as its forward end to the chair frame, the rod slowly threading in and out of rotating tube 36 to cause chair 12 to lift, tilt, lower, or recline as desired. In standard fashion, an occupant 40 controls reversible motor unit 30 by actuating lever 42 of switch assembly 44 in an up or down direction. As already mentioned mechanism 14 may be any of the prior patented designs or commercial designs listed above.

Base assembly 18 also includes a lower stationary support plate 50 resting via leveler legs 52 on a support surface such as a floor, and a large annular bearing 54 sandwiched between plates 16 and 50 and fastened to plate 50. A centered trunnion pin 56 connects plates 16 and 50 together and permits rotation or swiveling of plate 16 with respect to plate 50 via bearing 54.

Figure 4:
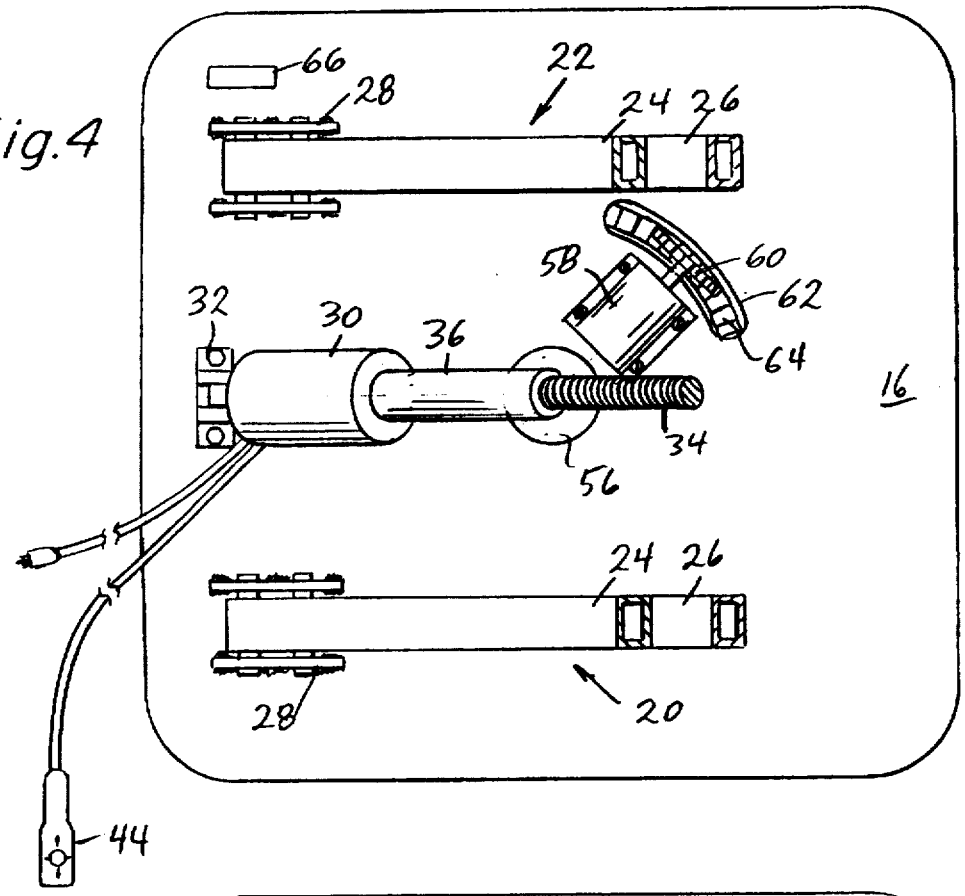
FIG. 4 is a fragmentary top plan view of an upper swivel plate of the base assembly on which the chair is mounted taken generally along line 4–4 of FIG. 1.
Figure 5:
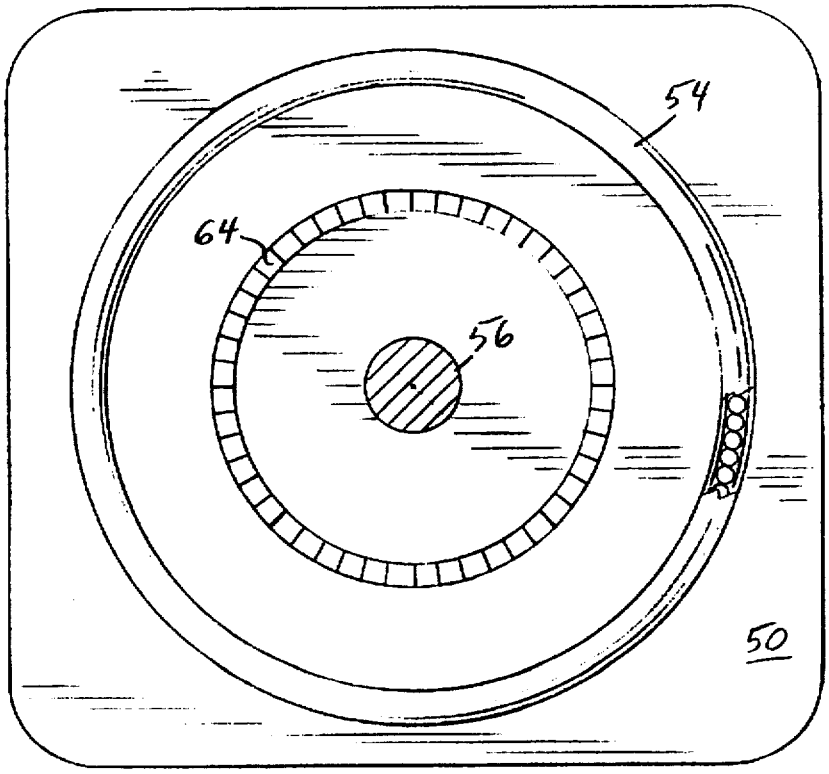
FIG. 5 is a fragmentary top plan view of the lower stationary plate of the base assembly taken generally along line 5–5 of FIG. 2.

In the embodiment of FIGS. 4 and 5, plate 16 may be slowly swiveled to the left or right by properly energizing reversible electric motor 58 mounted on top of plate 16. A small gear 60 mounted on the motor shaft extends downwardly through an arcuate slot 62 into engagement with a ring gear 64 fixed on top of plate 50. As motor 58 slowly rotates, gear 60 rides along gear 62 to slowly turn or swivel plate 16 and chair 12 to the right or left as desired. To swivel the chair, occupant 40 merely pushes lever 42 right or left as necessary.

For safety purposes it may be desirable to prevent swiveling movement of plate 16 and chair 12 when the chair is raised from the seating position of FIG. 2. In raised position, a limit switch 66 mounted on top of plate 16 will be open to prevent motor 58 from being energized. When chair 12 is lowered to the seating position of FIG. 2, a bottom edge of the chair will close switch 66 which will permit energization of motor 58 upon actuation of lever 42 to the left or right position.

Figure 6:
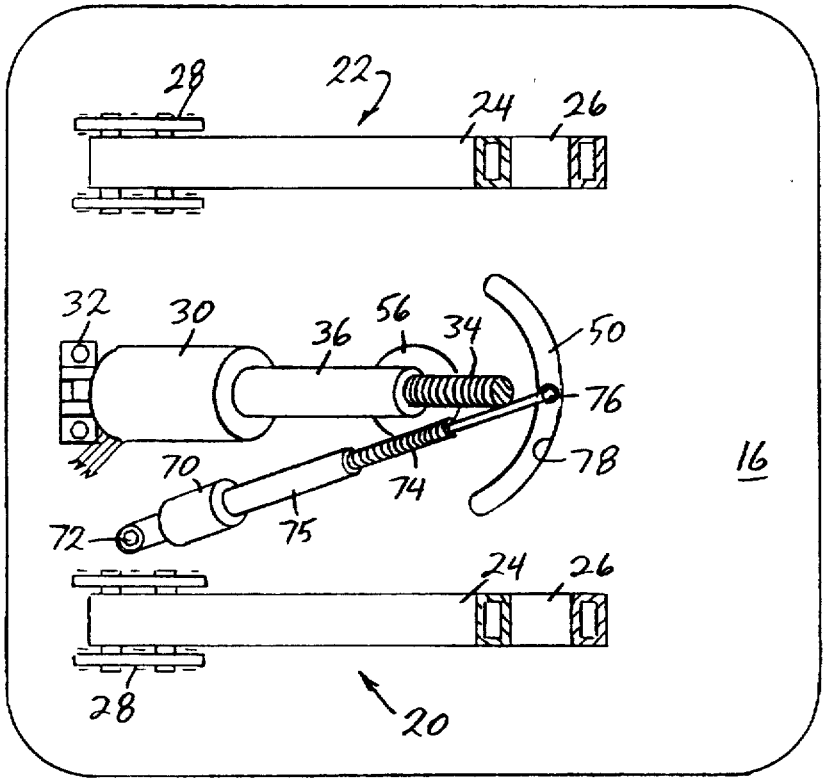
FIG. 6 is a top plan similar to FIG. 4 illustrating an alternative drive unit for turning the upper swivel plate relative to the lower stationary plate.

In the embodiment of FIG. 6, plate 16 is slowly swiveled by actuation of a motor/reducer unit 70 which is essentially the same as unit 30. The rear end of unit 70 is pivotally mounted about a vertical pin 72 fixed on plate 16. The forward end of threaded rod 74 is pivotally connected to a vertical clevis pin 76 fixed to bottom plate 50 and extending upwardly through arcuate slot 78 in plate 16. Unit 70, including tube 75 and rod 74, extend generally horizontally across plate 16 underneath unit 30, tube 36 and rod 34, and the units do not interfere with operation of each other. As motor 70 is rotated in a desired direction by actuation of lever 42, rod 74 threads in or out of rotating tube 75, pulling or pushing against pin 76, to swivel plate 16 relative to plate 50 as desired.

Figure 7:
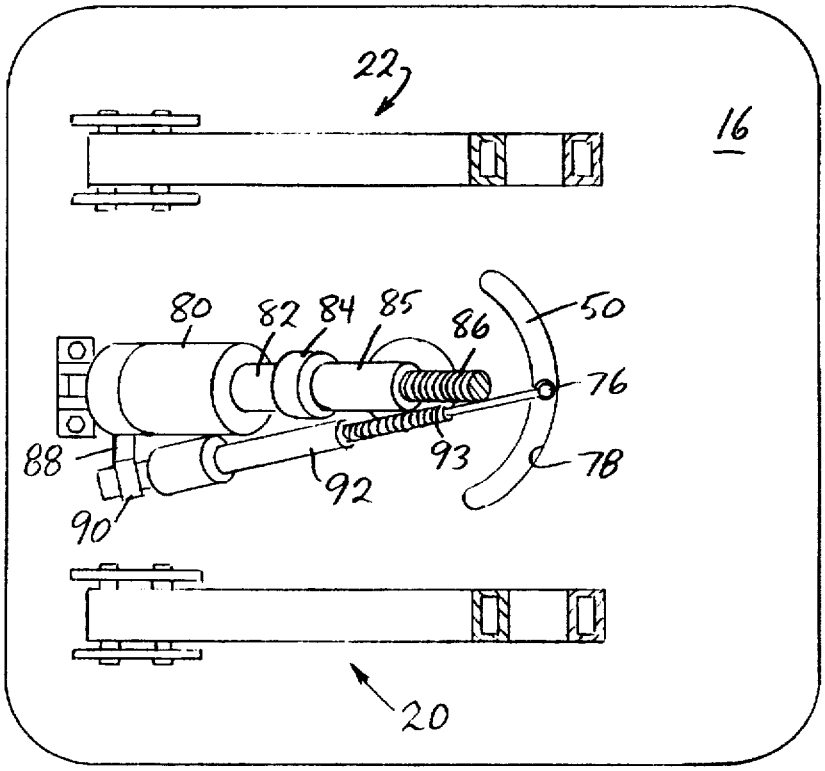
FIG. 7 is a view similar to FIG. 6 illustrating another alternative drive unit for turning the upper swivel plate relative to the lower stationary plate.

In the embodiment of FIG. 7, one reversible motor/reducer unit 80 has one output shaft 82 drive connected via a normally disengaged electrically operated clutch 84 to the tube 85 and rod 86 for tilting the chair. Unit 80 has a second output shaft 88 connected via a normally disengaged electrically operated clutch 90 to the rotating tube 92 and rod 93 for swiveling plate 16 relative to plate 50. To raise or lower the chair, the occupant will push lever 42 up or down to properly rotate unit 80 and to engage clutch 84 and rotate tube 85. Similarly, to swivel chair 12 when it is in the seating position of FIG. 2 and limit switch 66 is closed, the occupant will push lever 42 left or right to properly rotate tube 92, threading rod 93 in and out of tube 92 and pulling or pushing against pin 76 to swivel plate 16 relative to plate 50.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

We claim:

1. Seating apparatus comprising a chair, a mechanism for moving said chair between a reclining position, a seating position and a raised forward tilting position, a base assembly including a lower support and an upper support rotatably mounted on said lower support, said mechanism and said chair being mounted on said upper support, motor means for operating said mechanism to move said chair between said seating and raised positions and for rotating said upper support with respect to said lower support, and electrical control means automatically responsive to movement of said chair from said seating position to a raised position to prevent said motor means from rotating said upper support when said chair is in a raised position.

2. Seating apparatus as claimed in claim 1, said motor means being mounted on said upper support and including first drive means connected to said mechanism to recline, raise and lower said chair and second drive means connected to said lower support to swivel said upper support and said chair with respect to said lower support, said control means preventing operation of said second drive means when said chair is in a raised position.

3. Seating apparatus as claimed in claim 2, said second drive means being connected to said lower support by an output gear which engages a ring gear mounted on said lower support.

4. Seating apparatus as claimed in claim 3, wherein said upper and lower supports are parallel plates rotatably connected together, the upper plate having an arcuate slot through which said output gear extends downwardly into engagement with said ring gear.

5. Seating apparatus as claimed in claim 2, wherein said second drive means includes an axially extensible tube and rod assembly, said upper support having an arcuate slot, a pivot pin connected to said lower support and extending upwardly through said slot, the outer end of said tube and rod assembly being pivotally connected to said pivot pin, said upper support being turned relative to said lower support as said tube and rod assembly is extended or retracted axially.

6. Seating apparatus as claimed in claim 2, wherein said second drive means includes an axially extensible tube and rod assembly, a pivot pin connected to said lower support and extending upwardly through said upper support, the outer end of said tube and rod assembly being pivotally connected to said pivot pin, said upper support being turned relative to said lower support as said tube and rod assembly is extended or retracted axially to push or pull against said pin.

7. Seating apparatus as claimed in claim 1, wherein said motor means is a single motor unit having two output drive connections one of which operates said mechanism to raise and lower said chair and the other of which swivels said upper support relative to said lower support.

8. Seating apparatus comprising a chair, a mechanism for moving said chair between a seating position and a raised forward titling position, a base assembly including a lower support and an upper support rotatably mounted on said lower support, said mechanism and said chair being mounted on said upper support, motor means for operating said mechanism to move said chair between said seating and raised positions and for rotating said upper support with respect to said lower support, said motor means being mounted on said upper support and including first drive means connected to said mechanism to raise and lower said chair and second drive means connected to said lower support to swivel said upper support and said chair with respect to said lower support, said second drive means including an axially extensible tube and rod assembly, said upper support having an arcuate slot, a pivot pin connected to said lower support and extending upwardly through said slot, the outer end of said tube and rod assembly being pivotally connected to said pivot pin, said upper support being turned relative to said lower support as said tube and rod assembly is extended or retracted axially.

9. Seating apparatus comprising a chair, a mechanism for moving said chair between a seating position and a raised forward titling position, a base assembly including a lower support and an upper support rotatably mounted on said lower support, said mechanism and said chair being mounted on said upper support, motor means for operating said mechanism to move said chair between said seating and raised positions and for rotating said upper support with respect to said lower support, said motor means being mounted on said upper support and including first drive means connected to said mechanism to raise and lower said chair and second drive means connected to said lower support to swivel said upper support and said chair with respect to said lower support, said second drive means including an axially extensible tube and rod assembly, a pivot pin connected to said lower support and extending upwardly through said upper support, the outer end of said tube and rod assembly being pivotally connected to said pivot pin, said upper support being turned relative to said lower support as said tube and rod assembly is extended or retracted axially to push or pull against said pin.

10. Seating apparatus comprising a chair, a mechanism for moving said chair between a seating position and a raised forward titling position, a base assembly including a lower support and an upper support rotatably mounted on said lower support, said mechanism and said chair being mounted on said upper support, motor means for operating said mechanism to move said chair between said seating and raised positions and for rotating said upper support with respect to said lower support, said motor means being mounted on said upper support and including first drive means connected to said mechanism to raise and lower said chair and second drive means connected to said lower support to swivel said upper support and said chair with respect to said lower support, said second drive means including an axially extensible tube and rod assembly, pivotal means connecting the outer end of said tube and rod assembly to said lower support, said upper support being turned relative to said lower support as said tube and rod assembly is extended or retracted axially to push or pull against said pivotal means.

11. Seating apparatus as claimed in claim 10, comprising control means automatically responsive to movement of said chair to a raised position to prevent said second drive means from swiveling said upper support when said chair is in a raised position.

* * * * *